US006360381B1

(12) United States Patent
Fitzgerald, Sr.

(10) Patent No.: US 6,360,381 B1
(45) Date of Patent: Mar. 26, 2002

(54) UNIVERSAL FIXTURE SUPPORT

(75) Inventor: Robert W. Fitzgerald, Sr., Monroeville, PA (US)

(73) Assignee: Jay R. Smith Mfg. Co., Montgomery, AL (US)

( * ) Notice: Subject to any disclaimer, the term of this patent is extended or adjusted under 35 U.S.C. 154(b) by 0 days.

(21) Appl. No.: 09/722,903

(22) Filed: Nov. 27, 2000

(51) Int. Cl.[7] ..... E03C 1/324

(52) U.S. Cl. ..... 4/645; 4/252.1; 4/695; 248/68.1

(58) Field of Search ..... 4/252.1, 252.2, 4/252.3, 643, 645, 647, 648, 670, 695; 137/360; 248/68.1

(56) References Cited

U.S. PATENT DOCUMENTS

| | | | | |
|---|---|---|---|---|
| 1,078,546 A | * | 11/1913 | McCarty et al. | 4/647 X |
| 2,716,757 A | | 9/1955 | Eriksson | 4/645 |
| 3,932,899 A | | 1/1976 | Brady et al. | 4/252.2 |
| 4,158,898 A | | 6/1979 | Denhart | 4/646 |
| 4,434,516 A | | 3/1984 | Morris et al. | 4/252.2 |
| 4,979,239 A | | 12/1990 | Klein et al. | 4/645 |
| 5,044,584 A | * | 9/1991 | Lin | 248/68.1 |
| 5,050,253 A | | 9/1991 | Wasek | 4/645 |
| 5,148,552 A | | 9/1992 | Kress et al. | 4/252.2 |
| 5,230,109 A | | 7/1993 | Zaccai et al. | 4/645 |
| 5,724,773 A | | 3/1998 | Hall | 52/34 |

FOREIGN PATENT DOCUMENTS

| | | | | |
|---|---|---|---|---|
| DE | 3033291 | * | 3/1982 | 4/252.2 |

OTHER PUBLICATIONS

Jay R. Smith Mfg. Co., Smith Yellow Pages, pp 1, 0–22, 0–L1, 0–L3, 0–L5, 0–L7, 0–L8, 0–L9, 1998. Montgomery, Alabama.

* cited by examiner

*Primary Examiner*—Robert M. Fetsuga
(74) *Attorney, Agent, or Firm*—William S. Ramsey

(57) ABSTRACT

This invention is a prefabricated very strong in wall support for universal fixtures mounted on a wall. Fixture support connectors or arms extend from the support and hold up the fixture. The in wall support is rigidly bolted to the floor so the support bears all the weight of the fixture and transmits the weight directly to the floor. The support is manufactured to accommodate standard fixtures. The height of the mounted fixture can be varied by moving the brackets which hold the fixture support connectors up and down. Brackets can be mounted on both the front and back of the support, thereby allowing the mounting of a fixture on both sides of a wall using a single support.

19 Claims, 10 Drawing Sheets

UNIVERSAL FIXTURE SUPPORT

CROSS-REFERENCE TO RELATED APPLICATIONS.

Not Applicable.

STATEMENT REGARDING FEDERALLY SPONSORED RESEARCH OR DEVELOPMENT.

Not Applicable.

Reference to a "Microfiche appendix."

Not Applicable.

BACKGROUND OF THE INVENTION

1. Field of the Invention

This invention relates to within the wall supports for wall mounted fixtures such as lavatories, urinals, hospital and laboratory sinks, and drinking fountains.

2. Description of Related Art Including Information Disclosed Under 37 CFR 1.97 and 37 CFR 1.98

Eriksson in U.S. Pat. No. 2,716,757 discloses a lavabos with a support consisting of two parallel vertical rods which are clamped to a frame which holds the basin. The support is not enclosed within the wall.

Brady et al. in U.S. Pat. No. 3,932,899 disclose a support frame with security means, the support frame intended to be case into an associated concrete wall. The frame consists of two parallel vertical side frame elements and parallel top and bottom frame elements. The patent discloses the elements as secured by welding. The frame is case into concrete to provide a secure and impassable support for the fixture when it is embedded in concrete. The frame has a facility attached to the vertical side frame elements. A lavatory and water closet are attached to the facility.

Denhart in U.S. Pat. No. 4,158,898 discloses an adjustable support for the front of a wall mounted washstand to resist the weight of a person sitting or standing on the washstand. The support is mounted below the washstand and rests on the floor in an exposed position.

Morris et al. in U.S. Pat. No. 4,434,516 disclose a jig for a poured concrete wall consisting of a base and top member and two vertical members each with a web and flange along the wall. Multiple fixtures are permanently mounted on the jig and cross members prevent passage of objects from one fixture to another. The jig does not bear the load of the lavatory or that of a mounted water closet, which are supported by a box-like fixture which rests on the floor.

Klein et al. in U.S. Pat. No. 4,979,239 disclose a support structure for wall-mounted sanitary apparatus with legs and crossmembers which support a water closet above the floor. The structure consists of two parallel crossmembers which are connected by legs inclined in a V shape. Adjustable cramps on the ends of the lower crossmember support the structure on the floor. In another embodiment, uprights are pivotally attached to the cramps and are used to support the structure in a desired elevated position.

Wasek in U.S. Pat. No. 5,050,253 discloses an adjustable vanity assembly with a rail assembly made of two vertical side members, a top member, and a bottom traverse support which is not flush with the floor. Gas springs which are visible below the vanity permit vertical movement of the vanity and lock the vanity at a desired vertical height.

Kress et al. in U.S. Pat. No. 5,148,552 disclose an assembly space apron consisting of a metal reinforced plate which is substantially resistant to bending and is embedded in foam. The apron extends below the installation module to the floor and conceals the waste water draining pipe elbow and prevents access to the area below the module.

Zaccai et al. in U.S. Pat. No. 5,230,109 disclose a vertically adjustable lavatory assembly with an outer frame and a movable carrier frame. The outer frame consists of a preferably rectangular support carrier frame with vertical side walls with apertures, a top cross-member and a bottom cross-member positioned horizontally between the side walls. The outer frame does not support the lavatory directly, but supports a moveable carrier frame which in turn supports the lavatory.

Hall in U.S. Pat. No. 5,724,773 discloses a prefabricated building module of parallel frames which support a water closet on either side. Angle brackets at the bottom of the module are anchored to the floor by anchor bolts. A larger embodiment of the module is prefabricated preferably with a ceiling and is finished with drywall.

SMITH YELLOW PAGES, Jay R. Smith Mfg. Co., 1998, pages 0–22, 0–L1, 0–L3, 0–L5, 0–L7, 0–L9, discloses a variety of in wall supports for off-the floor urinals and lavatory and sink supports, drinking fountain, and electric water cooler supports. The supports consist of vertical uprights with sleeves or other adjustable arm supports attached to the uprights. No unitary supports are disclosed.

The prior art does not disclose in wall universal fixture supports of the present invention. The present invention has the advantages of being a prefabricated unitary support which is stronger than, requires less space for installation than, and is installed with less labor than conventional prior art supports.

BRIEF SUMMARY OF THE INVENTION.

The support of this invention is mounted in a wall and is rigidly attached to the floor. The support is used to hold universal fixtures which are mounted above the floor. The support is based on a rigid frame of two parallel side bars and an upper and a lower cross bar. The upper cross bar is permanently attached to one end of each side bar, the lower cross bar is permanently attached to the other end of each side bar, the side bars are perpendicular to the cross bars, and the frame defines a plane. Both cross bars have cut-outs to accommodate services and the lower cross bar has means for attaching the lower cross bar to the floor. A bracket is adjustably attached to each side arm, and each bracket has attached a connector for universal fixtures. A universal fixture connector is used to support and connect a universal fixture to the support. A universal fixture connector is attached to the bracket and the universal fixture extends approximately perpendicular to the plane of the frame. Brackets may be attached to both the front and the rear sides of the frame which allows one frame to serve to support universal fixtures on both sides of a wall.

The objective of this invention is to provide an in wall universal fixture support which transmits the weight of the universal fixture directly to the floor without transmitting substantial weight to the wall.

Another objective of this invention is to provide an in wall universal fixture support which is prefabricated with standard dimensions which accommodates a wide variety of universal fixtures.

Another objective of this invention is to provide an in wall universal fixture support in which the height of the universal fixture retention arms can be varied in order to comply with regulatory requirements.

Another objective of this invention is to provide an in wall universal fixture support with enhanced stability.

Another objective of this invention is to provide an in wall universal fixture support which can be installed with a minimum of time and labor.

Another objective of this invention is to provide an in wall universal fixture support with reduced space requirements.

Another objective of this invention is to provide an in wall universal fixture support with provisions for water, waste, and vent line pipe and electrical wiring installation without further drilling or tapping.

Another objective of this invention is to provide an in wall universal fixture support with enhanced strength which resists overloads placed on the universal fixture.

Another objective of this invention is to provide an in wall universal fixture support which can be shipped to the installation site in an assembled condition which requires only the adjustment of the height of the lavatory retaining arms during installation.

Another objective of this invention is to provide an in wall universal fixture support of universal application for supporting standardized universal fixtures produced by any commercial manufacturer.

Another objective of this invention is to provide an in wall universal fixture support which may be used to support a single universal fixture on one wall or may be used to support two universal fixtures, each mounted on the opposite sides of a wall.

A final objective of this invention is to provide an in wall universal fixture support which is inexpensive, easily manufactured, and which is manufactured and installed without adverse effect on the environment.

DETAILED DESCRIPTION OF THE INVENTION

In this patent application, the term "universal fixture" means a sink, fixed basin, urinal, drinking fountain, electric water cooler, and other similar structures, all of which have a structure which holds water, have a source of running water, have a drainpipe which removes water from the structure, and are mounted above the floor. The term "in wall" means the support is located in the space behind a finished wall. The term "services" means pipes or conduits for providing water to, removing waste water from, or venting a universal fixture, or providing wires for providing electricity to a universal fixture.

Figure 1:
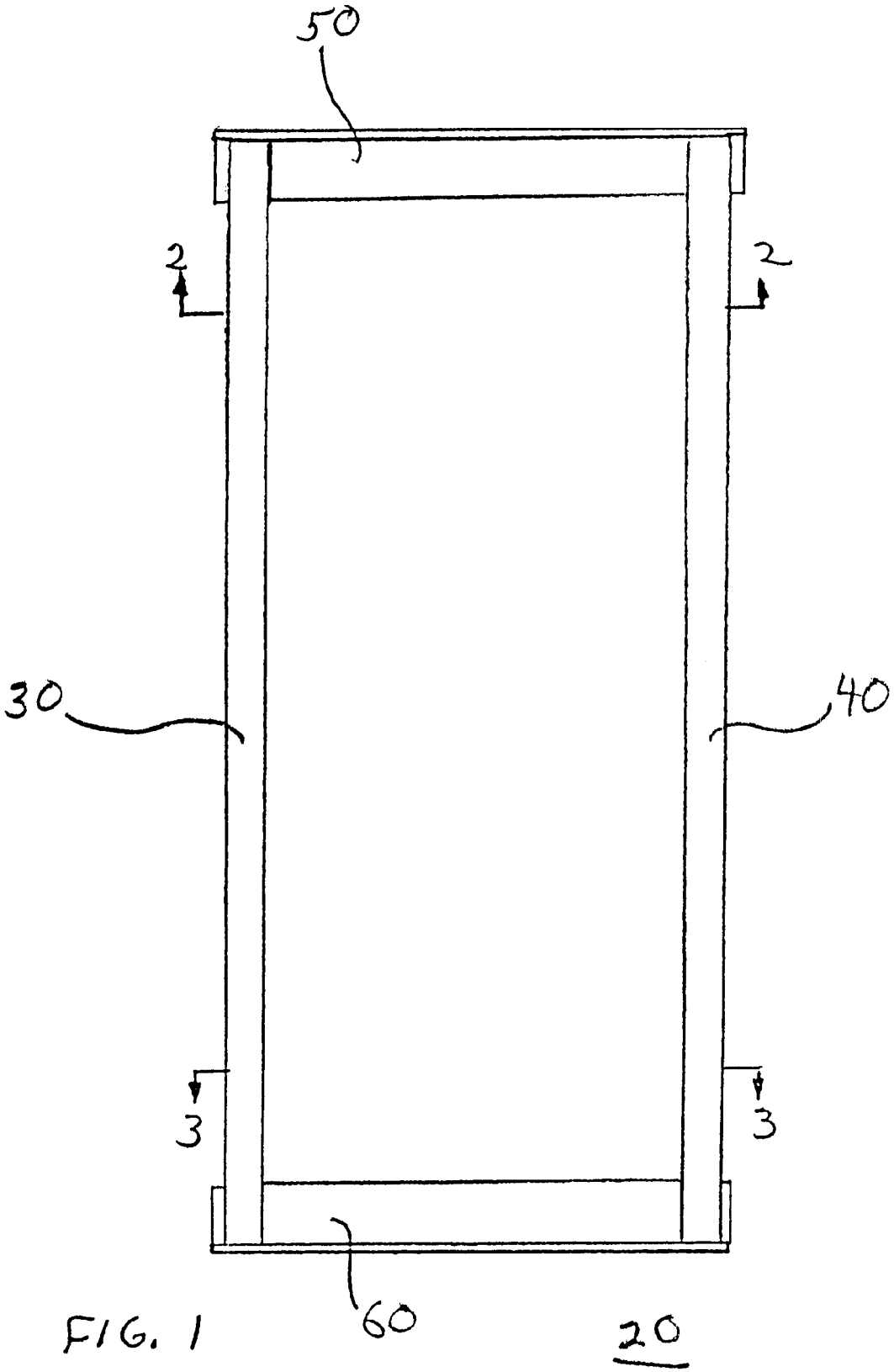
FIG. 1 is a plan view of the frame.

FIG. 1 shows the in wall support frame 20. The frame is rectangular in shape with an elongated left side bar 30 and a right side bar 40, both of which are permanently attached to the lower cross bar 60 and the upper cross bar 50. The side bars 30 and 40 are parallel and each side bar is perpendicular to the upper cross bar 50 and the lower cross bar 60. Although tubes rectangular in cross-section are used as side arms in this example, other cross-sectional shapes may be used for side arms, such as solid rectangular rods, circular rods or tubes, or other shapes with suitable strength and rigidity. Any suitable permanent and strong method of connecting the side bars and cross bars, such as securing with bolts, permanent adhesives, or welding. A preferred connecting method is robot welding in a precision locating fixture to assure consistent sizing, squareness and improved loading strength. In the preferred process, the finish weldments are cleaned and powder coated for environmental protection and ease of handling. Any suitable strong, rigid material resistant to deformation, such as steel, iron, aluminum, or fiberglass may be used in construction of the in wall support of this invention. A preferred material for the side bars and cross bars is 1010/1015 grade hot drawn steel.

In a preferred manufacturing process, the support is prefabricated in a factory.

The lower cross bar is firmly attached to the floor by suitable strong and rigid fastening means. All the weight of the support and the universal fixture, and all of the loading which might be placed on the fixture, is transmitted through the support directly to the floor. None of the weight is borne by the wall.

Figure 2:
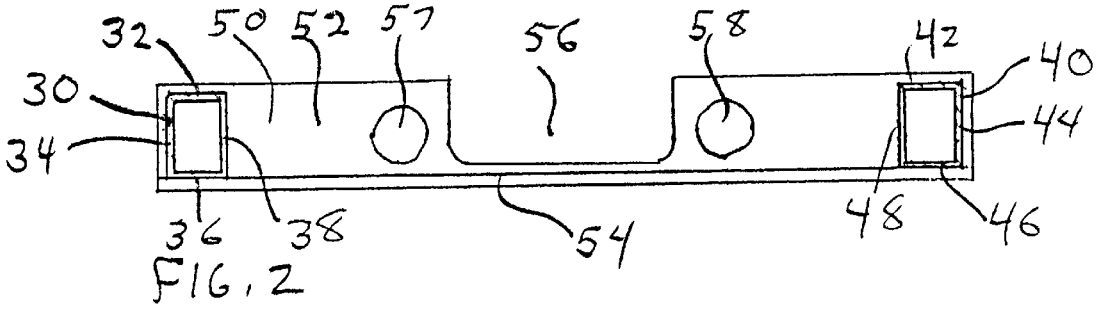
FIG. 2 is a cross section view of the frame taken along line 2—2.

FIG. 2 is a cross-section view along line 2—2 of FIG. 1. Fig two shows the underside of the upper cross bar 50. The cross bar consists of a web 52 and a flange 54 which is at a right angle to the web 52. Both the web 52 and flange 54 are of approximately the same width. A cut-out 56 in the web 52 accommodates services such as pipes which serve to provide water, drain water, or vent the universal fixture and electrical wires. Further circular cutouts 57 and 58 provide additional spaces for services to the universal fixture. Left side bar 30 is shown in FIG. 2 where it is welded to the upper cross bar 50. The left side bar 30 front side 32, inside side 38, back side 36, and outside side 34 are also shown. The left side bar back side 36 is flush with the flange 54. Right side bar 40 is shown in FIG. 2 where it is welded to the upper cross bar 50. The right side bar 40 front side 42, inside side 48, back side 46, and outside side 44 are also shown. The right side bar back side 46 is flush with the flange 54.

Figure 3:
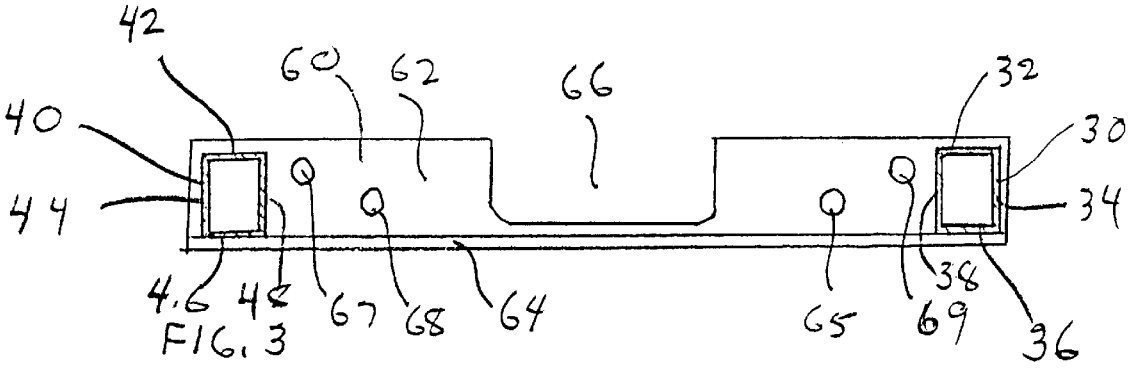
FIG. 3 is a cross section view of the frame taken along line 3—3.

FIG. 3 is a cross-section view along line 3—3 of FIG. 1. FIG. 3 shows the upper side of the lower cross bar 60. The cross bar consists of a web 62 and a flange 64 which is at a right angle to the web 62. Both the web 62 and flange 64 are of approximately the same width. A cut-out 66 in the web 62 accommodates services such as pipes which serve to provide water, drain water, or vent the universal fixture or electrical wires. Further holes 65, 67, 68, and 69 are used to rigidly attach the lower cross bar 60 to the floor when the in wall support is installed. Two bolts or other suitable strong fasteners are used to make the connection with the floor. A variety of suitable means may be used to make a strong, rigid connection between the lower cross bar and the floor, such as bolts, brackets, mortar, or adhesive. Left side bar 30 is shown in FIG. 3 where it is welded to the upper cross bar 50.

The left side bar 30 front side 32, inside side 38, back side 36, and outside side 34 are also shown. The left side bar back side 36 is flush with the flange 64. Right side bar 40 is shown in FIG. 3 where it is welded to the upper cross bar 50. The right side bar 40 front side 42, inside side 48, back side 46, and outside side 44 are also shown. The right side bar back side 46 is flush with the flange 64.

Figure 4:
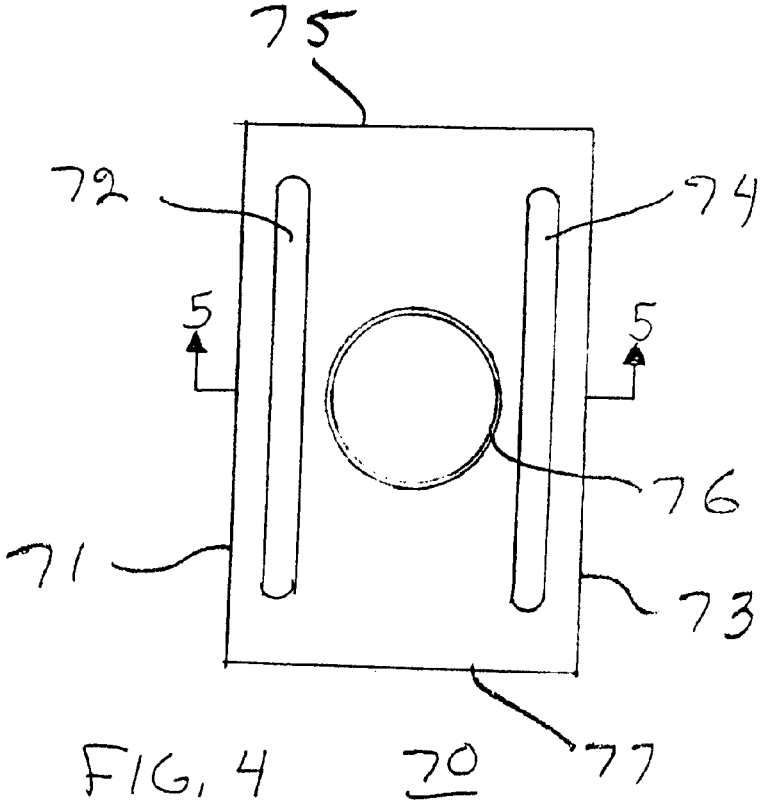
FIG. 4 is a plan view of the first embodiment bracket.

FIG. 4 is a plan view of the first embodiment bracket 70. The bracket 70 is rectangular with parallel long sides 71 and 73 and parallel short sides 75 and 77. An internally-threaded socket 76 is welded to the bracket. The socket 76 receives the threaded end of an universal fixture connector or extended lavatory retention arm (78 in FIG. 7) which supports and retains the universal fixture. Extended slots 72 and 74 are parallel with the long sides 71 and 73. Bracket 70 is adjustably attached to the front side of a side arm by U-bolts which extend around the side arm and the ends of each U-bolt extends through the extended slots 72 and 74. Nuts secure the bracket to the side arm. The bracket can be adjusted vertically on the side arm. A preferred material for the bracket is 1010/1015 hot drawn steel plate with a NPS conduit coupling welded to it. A preferred material for the U-bolts and straight bolts, nuts and washers is Grade 3 steel.

Figure 5:
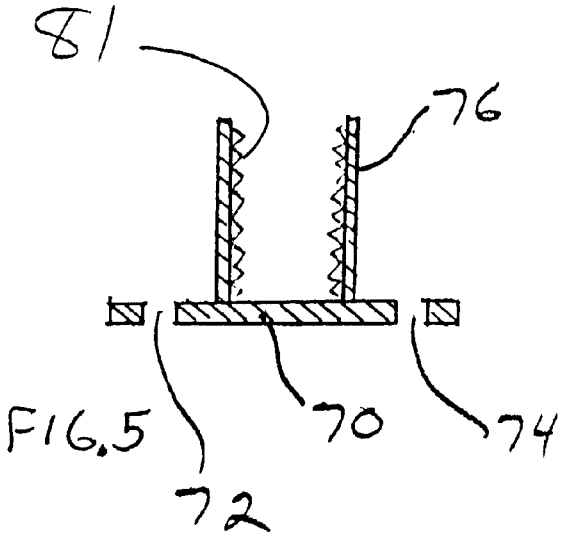
FIG. 5 is a cross section view of the bracket taken along line 5—5.

FIG. 5 is a cross section-view taken along line 5 of FIG. 4. Bracket 70 is shown along with slots 72 and 74 and socket 76. Also visible are the threads 81 on the inside of the socket. The socket 76 is mounted perpendicular to the flange.

Figure 6:
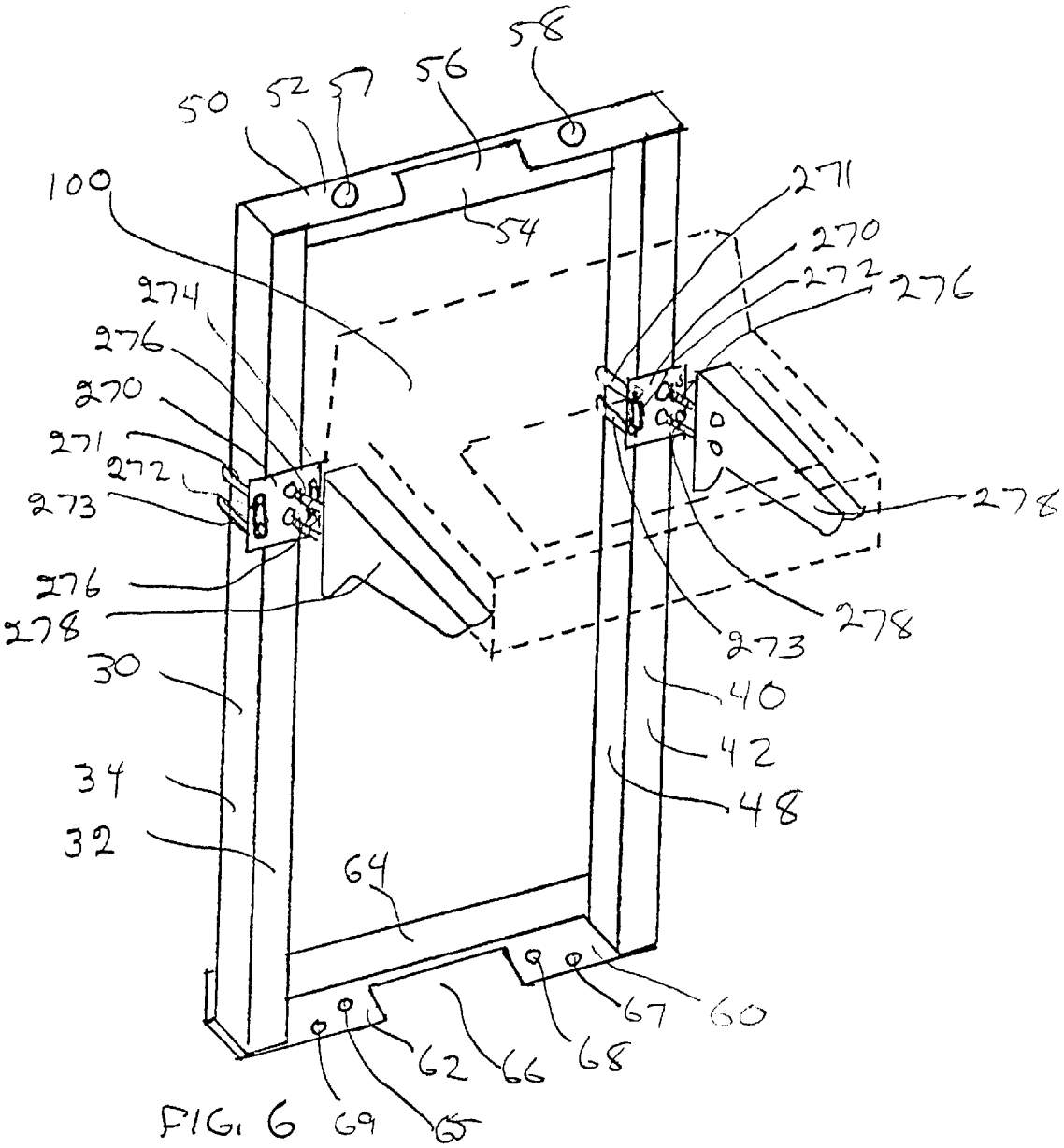
FIG. 6 is a perspective view of the in wall support with the finish wall removed.

FIG. 6 is a perspective view of an in wall support showing in dotted line a universal fixture, in FIG. 6, a sink 100. FIG. 6 shows the upper side of the lower cross bar 60. The cross bar consists of a web 62 and a flange 64 which is at a right angle to the web 62. Both the web 62 and flange 64 are of approximately the same width. A cut-out 66 in the web 62 accommodates services such as pipes which serve to provide water, drain water, or vent the universal fixture or electrical wires. Further holes 65, 67, 68, and 69 are used to rigidly attach the lower cross bar 60 to the floor when the in wall support is installed. Two bolts are used to make the connection with the floor. Other suitable strong fasteners may be used to make the connection with the floor. A variety of suitable means may be used to make a strong, rigid connection between the lower cross bar and the floor, such as bolts, brackets, mortar, or adhesive.

FIG. 6 shows the upper side of the upper cross bar 50. The upper cross bar consists of a web 52 and a flange 54 which is at a right angle to the web 52. Both the web 52 and flange 54 are of approximately the same width. A cut-out 56 in the web 52 accommodates services such as pipes which serve to provide water, drain water, or vent the universal fixture, or electrical wires. Further circular cutouts 57 and 58 provide additional spaces for services to the universal fixture. Left side bar 30 is shown in FIG. 6 where it is welded to the upper cross bar 50 and lower cross bar 60. The left side bar 30 front side 32 and outside side 34 are also shown. Right side bar 40 is shown in FIG. 6 where it is welded to the upper cross bar 50 and lower cross bar 60. The right side bar 40 front side 42 and inside side 48 are also shown.

A second embodiment flange is shown in FIG. 6. The second embodiment flange 270 is identical to the first embodiment flange 70 of FIG. 4 except in the second embodiment the attachment for a lavatory retention arm consists of bolts 276 which extend through holes in the second embodiment flange 270. The second embodiment flange 270 does not have a socket, 76 in FIG. 4. A second embodiment extended lavatory retention arm 278 is shown in FIG. 6. The second embodiment arm differs from the first embodiment arm in the bracket attachment and in that the second embodiment arm is designed to support the universal fixture from below and to be visible while the first embodiment arm is designed to support the fixture through extension into a hole in the back of the fixture. The first embodiment universal fixture retention arm is not visible when the universal fixture is installed.

FIG. 6 shows the second embodiment bracket 270 and extended lavatory retention arm 278 attached to left side arm 30, and an identical bracket and arm attached to right side arm 40.

Figure 7:
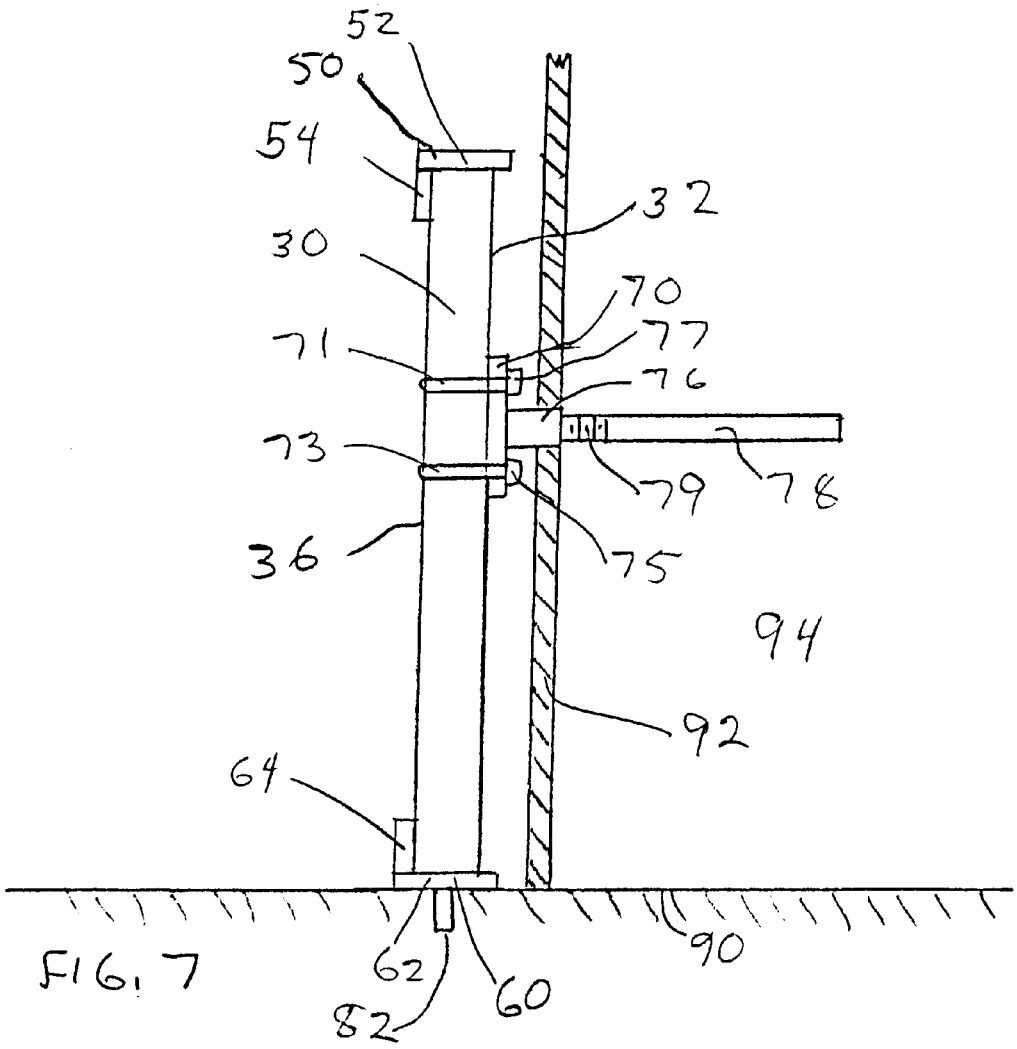
FIG. 7 is a side view of the in wall support showing the finish wall in cross-section.

FIG. 7 is a side view of an installed in wall support. In room 94 the floor 90 and the finish wall 92 are shown in cross-section. The lower cross arm 60 is attached to the left side arm 30. Visible in FIG. 7 is the lower cross arm web 62 and lower cross arm flange 64. The lower cross arm flange 64 is attached to the floor 90 by bolts 82. The upper cross arm 50 is shown along with the upper cross arm web 52 and upper cross arm flange 54. Bracket 70 is attached to the front side 32 of the left arm 30 by U-bolts 71 and 73 which extend around the rear side 36 of the left arm 30 and are secured by nuts 75 and 77. The socket 76 is attached to the bracket 70 and extends approximately perpendicular from the bracket 70. The first embodiment extended lavatory retention bar 78 is attached by a threaded portion 79 to the socket 76.

Figure 8:
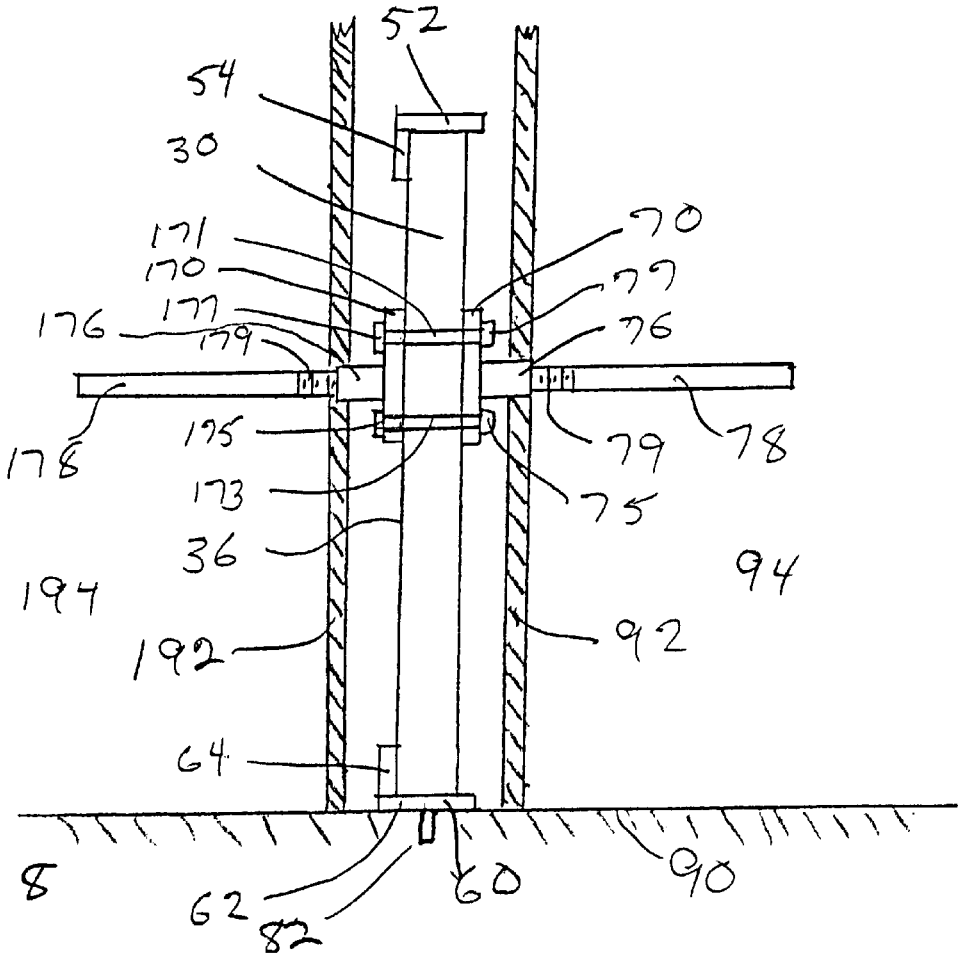
FIG. 8 is a side view of the two sided in wall support used to support two universal fixtures with the finish walls in cross-section.

FIG. 8 shows a second embodiment in wall support in which one support is used to support two universal fixtures located in a first 94 and a second 194 back-to-back rooms which share a common wall. FIG. 8 is identical to FIG. 7, and the second embodiment identical to the first embodiment with respect to elements designated by a number less than 100. The second finish wall 192 located in the second room 194 is shown in cross section. The bracket 170 is attached to the rear side 36 of the left arm 30 by bolts 171 and 173 and secured by nuts 175 and 177. The socket connector 176 is attached to the bracket 170 and extends approximately perpendicular from the bracket 170. The first embodiment extended lavatory retention bar 178 is attached by a thread 179 to the socket connector 176.

Figure 9:
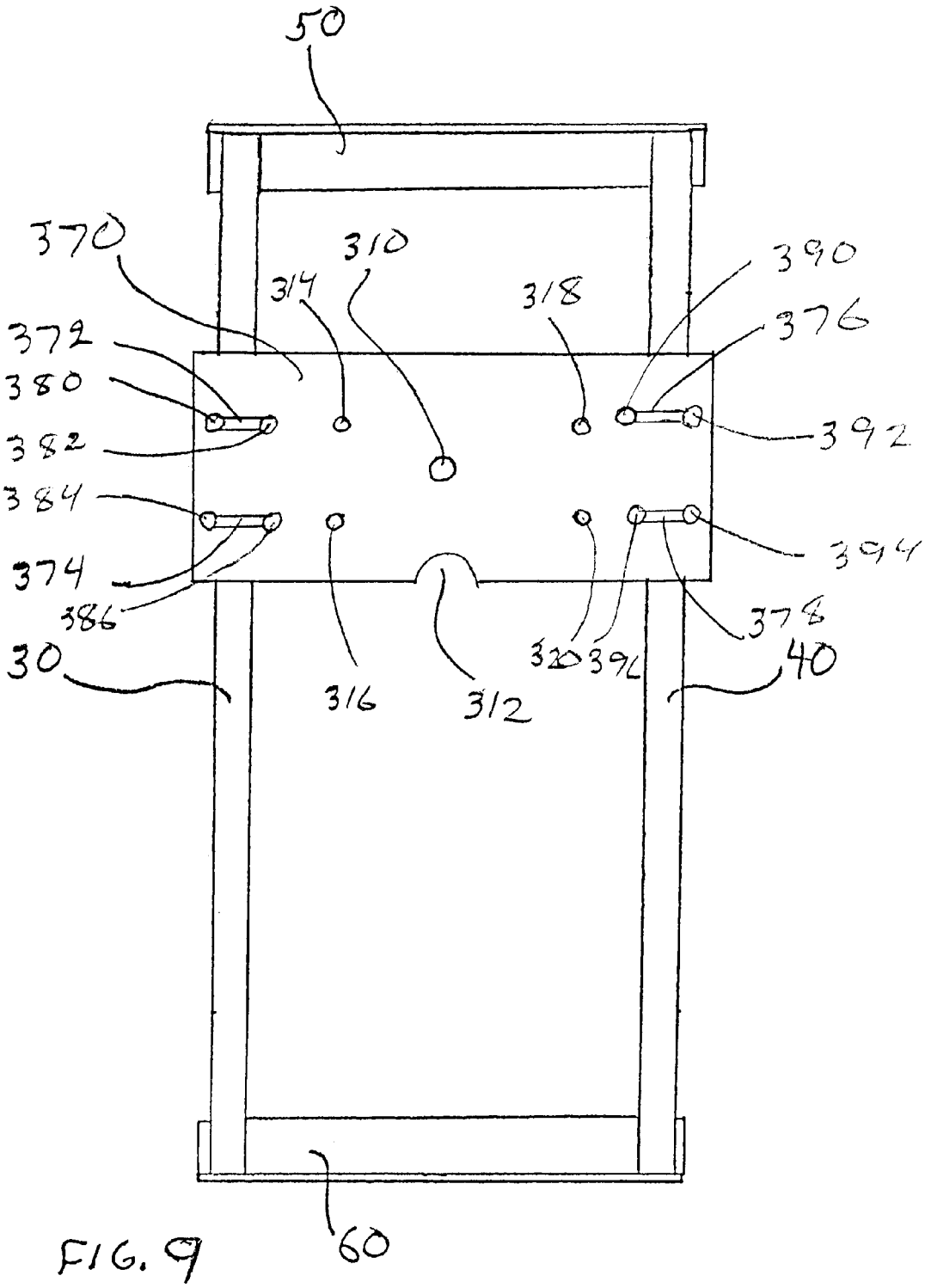
FIG. 9 is a plan view of a support for a drinking fountain.

FIG. 9 shows a plan view of a support for a drinking fountain. The in wall support frame is the same as that in FIG. 1. The bracket 370 extends from the left side arm 30 to the right side arm 40. Slots 372 and 374, 376 and 378 are used to connect the bracket 370 to left side arm 30 and right side arm 40, respectively. U-bolt which extend around the side arms are attached to the bracket by bolts 380, 382, 384, 386, 390, 392, 394, and 396. Holes 314, 316, 318, and 320 are used to accommodate connector bolts which connect the drinking fountain to the bracket 370. Hole 310 accommodates a water source for the drinking fountain and cut-out 312 accommodates the drain pipe.

Figure 10:
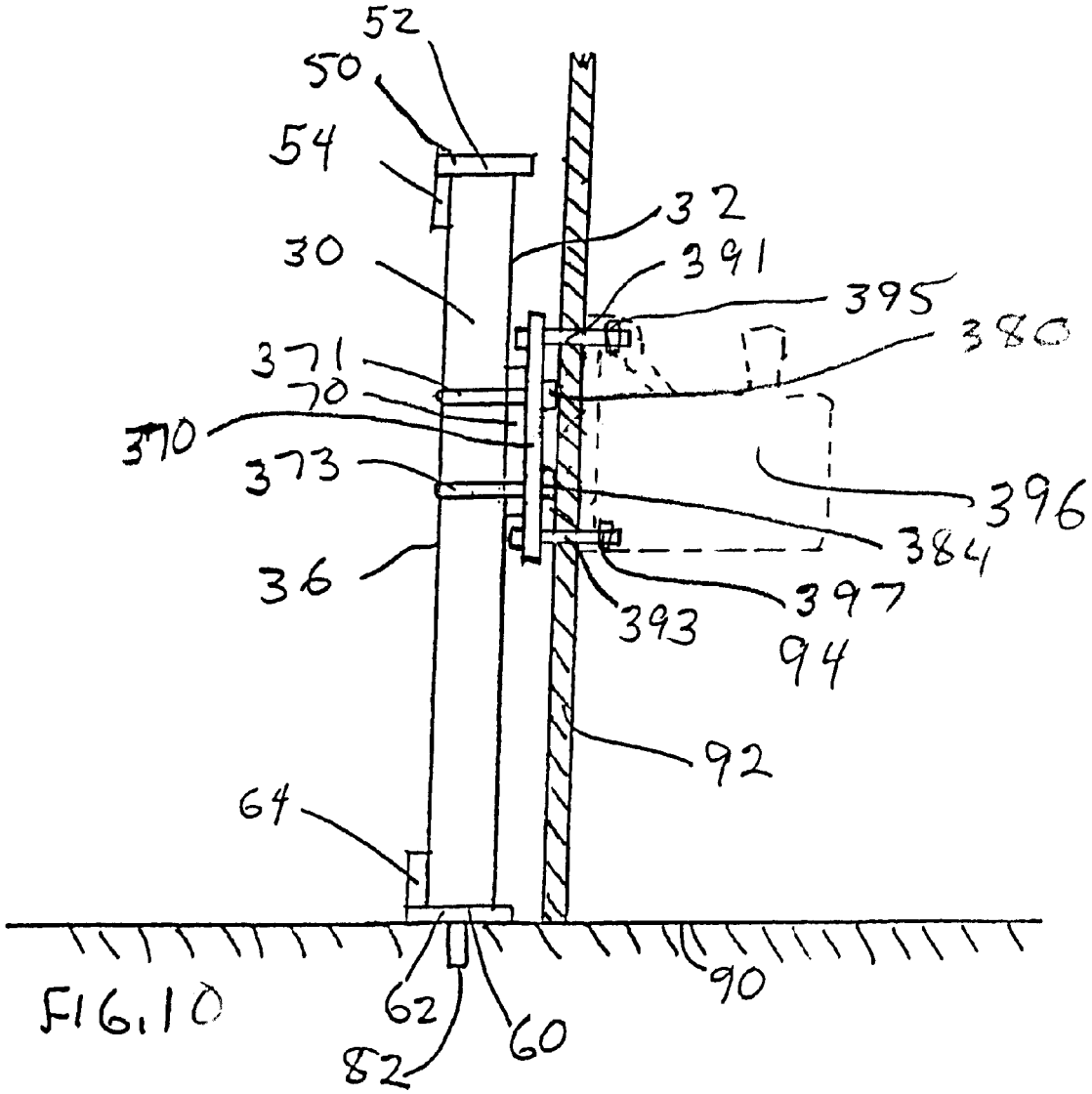
FIG. 10 is a side view of the in wall support for a drinking fountain.

FIG. 10 is a side view of an installed in wall support for a drinking fountain, indicated by dotted lines at 396. The in wall support frame is the same as that in FIG. 7. Bracket 370 is attached to the front side 32 of the left arm 30 by U-bolts 371 and 373 which extend around the rear side 36 of the left arm 30 and are secured by nuts 380 and 384. Universal fixture connector bolts 391 and 393 are attached to bracket 370 and extend approximately perpendicular from bracket 370. Bolts 391 and 393 support the drinking fountain 396 and are secured by nuts 395 and 397, respectively.

Figure 11:
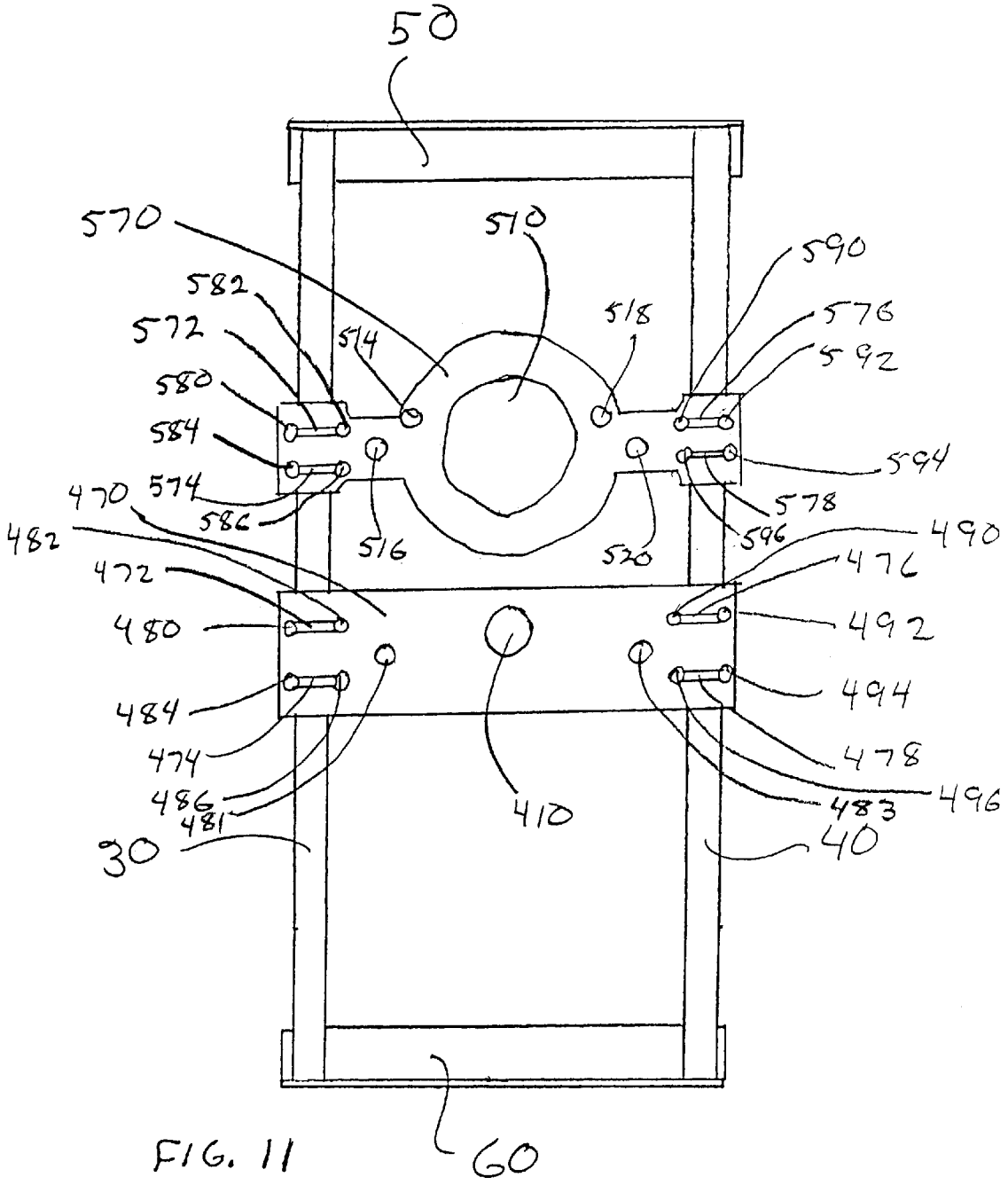
FIG. 11 is a plan view of a support for a urinal.

FIG. 11 shows a plan view of a support for a urinal. The in wall support frame is the same as that in FIG. 1. An upper bracket 570 and a lower bracket 470 support the urinal.

The lower bracket 470 extends from the left side arm 30 to the right side arm 40. Slots 472 and 474, 476 and 478 are used to connect the lower bracket 470 to left side arm 30 and right side arm 40, respectively. U-bolts which extend around the side arms are attached to the bracket by bolts 480, 482, 484, 486, 490, 492, 494, and 496. Holes 481 and 483 are used to accommodate connector bolts which connect the urinal to the bracket 470. Hole 410 accommodates services for the urinal.

The upper bracket 570 extends from the left side arm 30 to the right side arm 40. Slots 572 and 574, 576 and 578 are used to connect the upper bracket 570 to left side arm 30 and right side arm 40, respectively. U-bolts which extend around the side arms are attached to the bracket by bolts 580, 582, 584, 586, 590, 592, 594, and 596. Holes 514, 516, 518 and 520 are used to accommodate connector bolts which connect the urinal to the upper bracket 570. Hole 510 accommodates the drain for the urinal.

Figure 12:
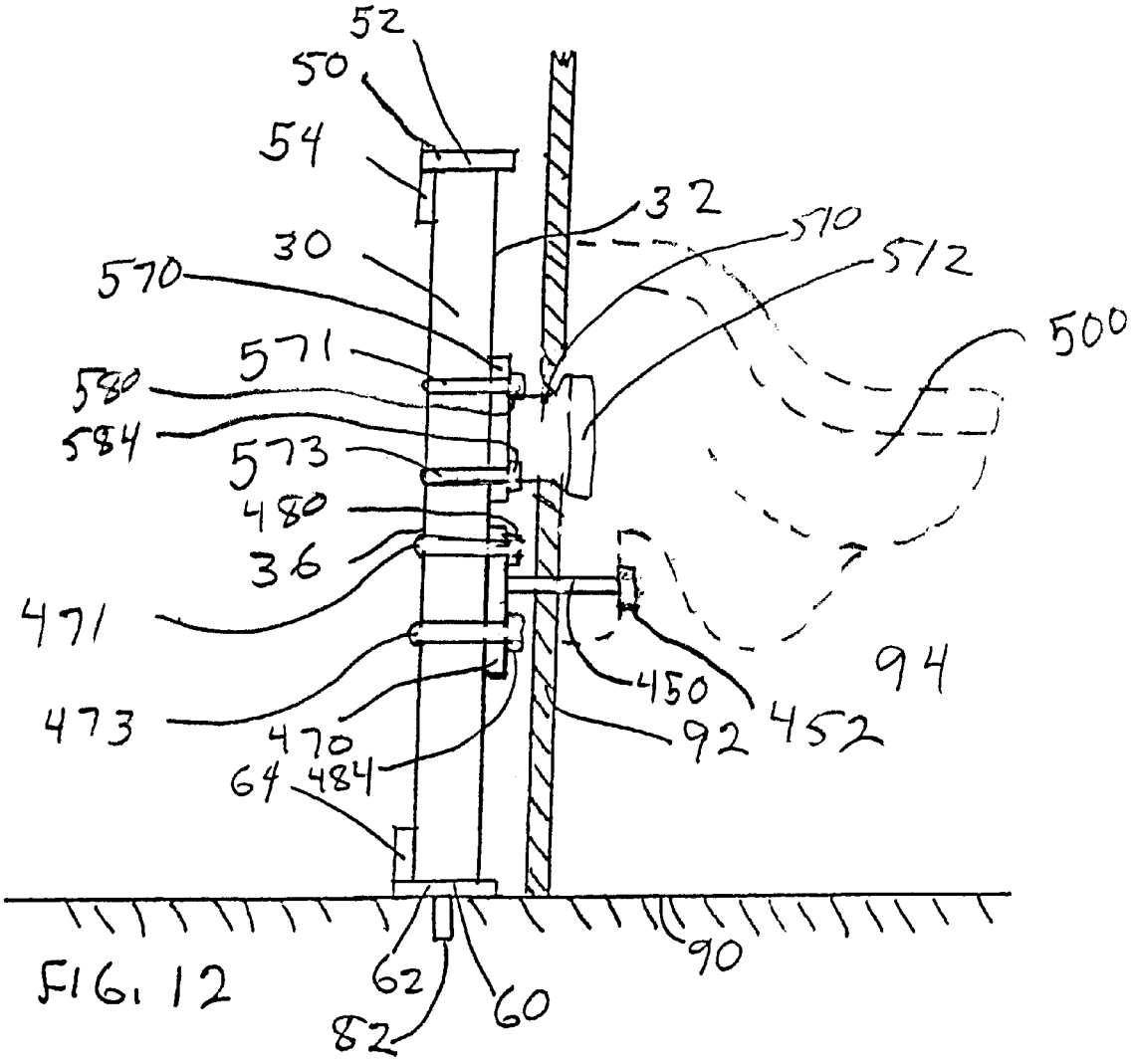
FIG. 12 is a side view of the in wall support for a urinal.

FIG. 12 is a side view of an installed in wall support for a urinal, indicated by dotted lines at 500. The in wall support frame is the same as that in FIG. 7. Upper bracket 570 is attached to the front side 32 of the left arm 30 by U-bolts 571 and 573 which extend around the rear side 36 of the left arm 30 and are secured by nuts 580 and 584. Universal fixture connector bolts which connect the urinal to the upper bracket are not shown in FIG. 12. A horn 510 extends from the bracket and accommodates the waste water from the urinal 500 through the fixture support to a wastewater pipe (not shown in FIG. 12). A gasket 512 seals the connection between the horn 510 and the urinal 500.

EXAMPLE 1

In a preferred example, the frame was constructed of side arms of rectangular tubes 1.50"×2.00"×0.125" in thickness, and 42.00" in length. The cross arms were of angle iron sections with the web and flange of 2.50" in width, 0.25" in thickness, and 20.00" in length. Both the side arms and cross arms were of 1010/1015 grade hot drawn steel. The support bracket was rectangular 4.00" by 6.00", and 0.250" in width. The support bracket was 1010/1015 hot drawn steel plate. A 1.00" NPS conduit coupling was robot welded to the bracket. The side arms were robot welded to the cross arms and the conduit coupling was robot welded to the bracket using precision locating fixtures to assure consistent sizing, squareness and improved loading strength. The finish weldments were cleaned and power coated for environmental protection and ease of handling. The brackets were mounted to the side arms using ⅜"-16thd., Grade 3 steel "U" bolts, nuts and washers.

The in wall support is precision prefabricated to accommodate standard universal fixtures widely available from manufacturers for commercial and institutional applications. The dimensions may be altered to accommodate custom or non-standard universal fixtures. The in wall support for universal fixtures of this invention is structurally stronger under a radial load than conventional supports, and requires the use of only two bolts to fasten the support to the floor, as opposed to the six or eight bolts required by conventional methods. Conventional methods use two independent vertical upright beams to support the fixture, which requires bolting of two independent beams to the floor, and, importantly, requires careful measurement to insure that the horizontal dimensions between the beams are appropriate. After the in wall support of the present invention is bolted to the floor, the only adjustment required is the vertical adjustment of the brackets. A considerable saving in skilled tradesperson labor is obtained through the use of the in wall support of the present invention, and the finished installation allows more accurate and reproducible placement of the fixture than does conventional installations.

The in wall support of the present invention may be installed in a minimal space between finished walls because of the provisions for providing services to the universal fixture without further drilling, tapping, or adding additional components.

It will be apparent to those skilled in the art that the examples and embodiments described herein are by way of illustration and not of limitation, and that other examples may be used without departing from the spirit and scope of the present invention, as set forth in the appended claims.

I claim:

1. An in wall support for supporting a universal fixture mounted above the floor comprising:

a frame comprised of two parallel side bars and an upper and a lower cross bar, the upper cross bar permanently attached to one end of each side bar, the lower cross bar permanently attached to the other end of each side bar, the side bars perpendicular to the cross bars, the frame defining a plane, the cross bars having cut-outs to accommodate pipes, the lower cross bar having cut-outs to accommodate fasteners for attaching the lower cross bar to the floor, a bracket adjustably attached to each side arm, the bracket having a connector for a universal fixture, the connector extending approximately perpendicular to the plane of the frame.

2. The in wall support of claim 1 wherein the support is mounted in a wall with the lower cross bar flush with and attached to the floor.

3. The in wall support of claim 1 wherein the side bars are attached to the cross bars by welding.

4. The in wall support of claim 1 wherein the fasteners which attach the lower cross bar to the floor are bolts.

5. The in wall support of claim 1 wherein a bracket is attached to a side arm by a U bolt.

6. The in wall support of claim 1 wherein the side arms are rectangular in cross-section having a front and rear wall, a left wall and a right wall.

7. The in wall support of claim 1 wherein a front bracket is attached to the front wall of the side arms and a rear bracket is attached to the rear wall of the side arms.

8. The in wall support of claim 7 wherein the front and rear brackets are attached to the side bars by fasteners which extend from the front bracket to the rear bracket.

9. The in wall support of claim 8 where the fasteners are bolts.

10. The in wall support of claim 1 wherein the cross bars are comprised of a web and a flange perpendicular to the web.

11. The in wall support of claim 1 wherein the connector is a lavatory retention arm, the lavatory retention arm has a threaded end, and the lavatory retention arm is removably connected by the threaded end to the bracket.

12. The in wall support of claim 1 wherein the connector is a lavatory retention arm which has a hole for a bolt, and the lavatory retention arm is removably connected to the bracket by a bolt in the threaded hole.

13. The in wall support of claim 1 wherein the bracket is attached to the left side arm and extends to and is attached to from the right side arm.

14. The in wall support of claim 1 wherein the universal fixture is an urinal which is attached to the frame by bolts attached to an upper bracket and a lower bracket.

15. The in wall support of claim 1 wherein the universal fixture is a drinking fountain which is attached to the frame by bolts attached to a bracket.

16. The in wall support of claim 1 wherein the universal fixture is a sink which is attached to the frame by an extended lavatory retention arm.

17. The in wall support of claim 1 wherein the universal fixture is a sink, fixed basin, urinal, drinking fountain, or a electric water cooler.

18. An in wall support for a universal fixture mounted above the floor comprising:

a frame comprised of a left and a right side bar, and an upper and a lower cross bar, each side bar rectangular in cross-section having front, rear, left, and right sides, each side bar having a first and a second end, each cross bar comprised of a web and a flange perpendicular to the web, each cross bar having a first and a second end, the upper cross bar welded to the first end of the left side bar, the first end of the left side bar flush with the web of the upper cross bar and at the first end of the upper cross bar, the upper cross bar welded to the first end of the right side bar, the first end of the right side bar flush with the web of the upper cross bar and at the second end of the upper cross bar, the lower cross bar welded to the second end of the left side bar, the second end of the left side bar flush with the web of the lower cross bar and at the first end of the lower cross bar, the lower cross bar welded to the second end of the right side bar, the second end of the right side bar flush with the web of the lower cross bar and at the second end of the lower cross bar, the side bars parallel to each other and perpendicular to the cross bars, the frame forming a plane, the flanges of the cross bars parallel to the plane of the frame and the webs of the cross bars perpendicular to the plane of the frame, the cross bars having cut-outs in the webs, the lower cross bar having hole for fastening the lower cross bar to the floor, a front bracket adjustably attached to the front side of each side bar by U-bolts, the front bracket having a female threaded socket for an extended lavatory retention arm, an extended lavatory retention arm having a threaded end, the extended lavatory retention arm removably connected to the socket by the threaded end, and the extended lavatory retention arm extending approximately perpendicular to the plane of the frame.

19. The in wall support of claim 18 further comprising:

a rear bracket adjustably attached to the rear side of each side bar, the rear bracket adjustably attached to the front bracket by bolts, the rear bracket having a female threaded socket for an extended lavatory retention arm, an extended lavatory retention arm having a threaded end, the extended lavatory retention arm removably attached to the rear bracket socket by the threaded end, and the extended lavatory retention arm extending approximately perpendicular to the plane of the frame.

* * * * *